United States Patent [19]

Miyai et al.

[11] Patent Number: 4,629,307

[45] Date of Patent: Dec. 16, 1986

[54] IMAGE FORMING APPARATUS WITH JAMMED PAPER ACCESS OPENING

[75] Inventors: Kiyoshi Miyai; Shuhei Uotani, both of Himeji; Toyohiko Tsunemine, Hyogo, all of Japan

[73] Assignee: Sanyo Electric Co., Ltd., Japan

[21] Appl. No.: 750,878

[22] Filed: Jul. 1, 1985

[30] Foreign Application Priority Data

Aug. 20, 1984 [JP] Japan ..... 59-172911

[51] Int. Cl.[4] ..... G03G 15/00

[52] U.S. Cl. ..... 355/3 R; 355/3 SH

[58] Field of Search ..... 355/3 R, 3 DR, 3 SH, 355/3 TR, 21

[56] References Cited

U.S. PATENT DOCUMENTS

| | | | |
|---|---|---|---|
| 3,286,589 | 11/1966 | Glidden | 355/21 |
| 4,435,068 | 3/1984 | Landa | 355/3 R |
| 4,465,359 | 8/1984 | Nakahata | 355/3 R |
| 4,526,464 | 7/1985 | Milillo | 355/3 SH |

*Primary Examiner*—Arthur T. Grimley
*Assistant Examiner*—J. Pendegrass
*Attorney, Agent, or Firm*—Darby & Darby

[57] ABSTRACT

An image forming apparatus which forms an opening larger in width than recording paper at the bottom of a casing in condition of normal use, the casing constituting a body housing therein main components, and which is provided with a guide means constituting part of a passing route of the recording paper in condition of normal use and constructed to be capable of projecting at one end from the opening at the bottom of the casing.

Hence, in the apparatus, even when the recording paper jams in the casing, a user can take out the jammed paper therefrom without dividing the casing and inserting fingers of a user into the casing. Accordingly, the apparatus, which can adopt integral construction not dividable, is realizable of being small-sized lightweight, and inexpensive to produce, and of saving the manhour for assembly, improving reliability, and reducing the failure occurrence rate.

8 Claims, 6 Drawing Figures

IMAGE FORMING APPARATUS WITH JAMMED PAPER ACCESS OPENING

BACKGROUND OF THE INVENTION

1. Field of the Invention

This invention relates to an image forming apparatus, and more particularly to an image forming apparatus which is so constructed that a recording paper, when jammed, can be taken out from a body of the apparatus without dividing the body into parts.

2. Description of the Prior Art

A conventional image forming apparatus, such as an electronic copier, when a recording paper is jammed in the body (casing) of the apparatus, is adapted to be disassembled laterally (in the direction of passing the recording paper) or vertically so that the interior of the body is exposed to take out therefrom the jammed recording paper.

For example, the Japanese Patent Publication (unexamined) No. 53-12335 (1978) discloses an apparatus which is constructed to make movable radially with respect to a photosensitive drum (latent image holder) a structure including a copying (recording) paper transportation (passing) route through which the copying paper reaches the drum.

Also, the Japanese Patent Publication (unexamined) No. 53-66743 (1978) discloses an apparatus constructed to be dividable into two of the upper portion providing at least an optical system and a latent image holder for projecting original images and the lower portion constituting a transportation route for the copying paper.

Both the above inventions, however, divide the apparatus body into several units, whereby it is apparent to make the apparatus as a whole fragile in structural strength. Hence, a chassis member must be higher in strength than it needs in comparison with the integral construction not-dividable, resulting in that the apparatus as a whole is large-sized, larger in weight, and high in a material cost.

Also, the divided units require members which connect them for transmitting thereto signals and power (electrical and mechanical), whereby its complicated construction has caused deterioration in reliability and the occurrence of failure.

Furthermore, it is required that lock members are provided to always align the relative positions of the units when reassembled. In case that such alignment is insufficient, the essential copying operation of the apparatus becomes improper to cause a failure therein.

OBJECTS OF THE INVENTION

In the light of the above problem, this invention has been designed.

A first object of the invention is to provide an image forming apparatus which can take out from the apparatus body a recording paper jammed therein in spite that the apparatus body is made not-dividable.

A second object of the invention is to provide an image forming apparatus from which a user can take out a jammed recording paper without inserting his fingers into the body.

A third object of the invention is to provide an image forming apparatus from which the jammed recording paper can be taken out with ease and safety from the apparatus body.

A fourth object of the invention is to provide an image forming apparatus of high reliability and less in the occurrence of failure.

A fifth object of the invention is to provide an image forming apparatus light weight, small-sized and inexpensive to produce.

The above and further objects and features of the invention will more fully be apparent from the following detailed description with accompanying drawings.

SUMMARY OF THE INVENTION

The present invention includes an image forming apparatus having a case with access opening means located beneath an area of the apparatus where paper jams are likely to occur, for permitting access to the jammed paper via a sliding access door normally covering the opening.

DETAILED DESCRIPTION OF THE INVENTION

Next, explanation will be given on an embodiment of the invention applied to a copier. The image forming apparatus of the invention of course is applicable to, for example, a printer as well as the aforesaid copier.

Figure 1:
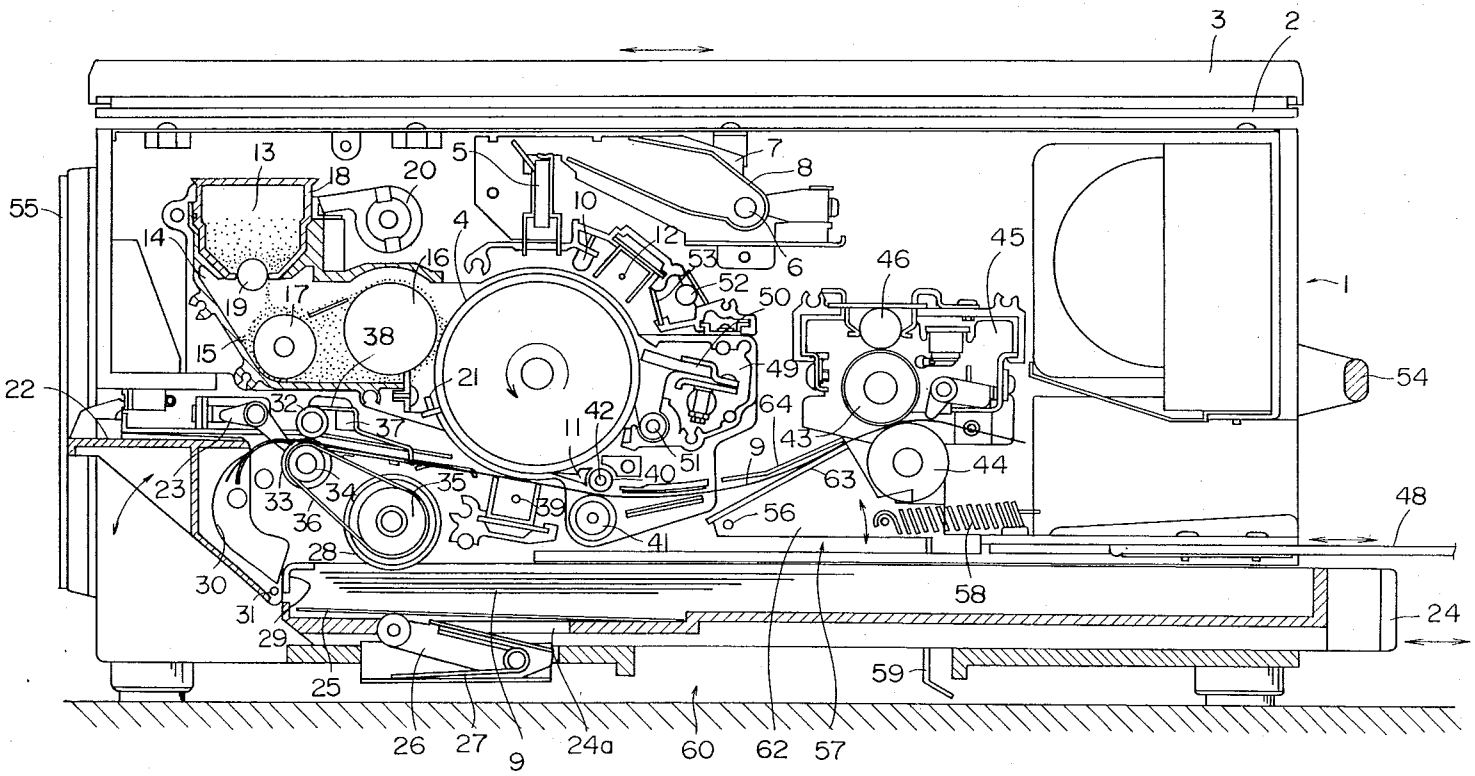
FIG. 1 is a sectional view of an embodiment of an image forming apparatus of the invention.

FIG. 1 is a schematic sectional view of the image forming apparatus of the invention.

A body 1 of the copier of the apparatus of the present invention is formed in a casing, and on the upper surface of the body 1, an original support plate 2 formed of a transparent glass plate is mounted in relation of being slidable laterally of the body 1 in FIG. 1.

A cover 3 freely opening or closing is mounted on the upper surface of the original support plate 2 so that an original, when the copier is operated, is sandwiched between the original support plate 2 and the cover 3 so as to be scanned laterally of the body 1 in FIG. 1. The body 1 is provided at a lengthwise intermediate portion with a photosensitive drum 4 as the latent image holder coated on the outer periphery with a sensitive material of polyvinyl carbazole and rotatable counterclockwise in FIG. 1. Above the top of the photosensitive drum 4 are suspended a row of lenses 5 each of short focus length for imaging on the outer periphery of the drum 4 the original placed on the original support plate 2. An exposure lamp (halogen lamp) 6 for illuminating the surface of original is provided at the right-hand side of the row of lenses 5 each of short focus length, the row of lenses 5 and the exposure lamp 6 being fixed to the same chassis 7. In addition, reference numeral 8 designates a reflector for the exposure lamp 6. Also, upstream of the row of lenses 5 each of short focus length in the paper passing direction is provided a side erase lamp 10 for removing (side-erasing) charge at portions of the photosensitive drum 4 corresponding to the side edges of copying paper 9 as the recording paper. Such side-erasing, as discussed below, serves to peel off the copying paper 9 from the photosensitive drum 4 by a peel-off pawl 11 abutting against the aforesaid portions. Upstream of the side erase lamp 10 in the rotation direction of the photosensitive drum 4 is fixed an electrifying corotron 12 for uniformly plus-electrifying (at about 600 V) the photosensitive drum 4.

At the downstream side of the row lenses 5 of short focus length in the rotation direction of the photosensitive drum 4 is provided a developing means 14 for developing with toner 13 the electrostatic latent images formed by the electrifying corotron 12 and the row of lenses 5, the developing means 14 containing rotatably a magnet roller 16 for conveying a developer of a mixture of toner and carrier toward the surface of the photosensitive drum 4 and a screw 17 for mixing the toner and carrier. Reference numeral 18 designates a toner hopper detachably mounted on the upper portion of the developing means 14. The toner hopper 18 is provided at the bottom thereof with a sponge roller 19 which feeds the toner 13 stored in the hopper 18 little by little to the developing means 14. Also, the toner hopper 18 is provided at the bottom thereof with a shutter (not shown) for preventing the toner 13 from leaking when the toner hopper 18 is transported, the shutter being adapted to be automatically opened upon mounting the toner hopper 18 on the developing means 14.

A counter 20 is mounted in the vicinity of the toner hopper 18, which operates each time the toner hopper 18 is exchanged, thereby counting the exchange times thereof. For example, when the count value of the counter 20 is five, it is displays on the body 1 that photosensitive drum 4 is to be exchanged. In a case where the count value of the counter 20 reaches a certain value, for example, "five" in the above example, a mechanism (not shown) for hindering a sixth exchange of toner hopper 18 is provided. At the downstream edge of the developing means 14 in the rotation direction of the photosensitive drum 4 is fixed a magnet 21 for arresting leaking carrier.

A hand-insertion paper feeder 22 is provided in the body 1 near the left side surface thereof in FIG. 1 so that the copying paper 9 is fed rightwardly of the body 1 from the hand-insertion paper feeder 22, a start switch 23 serving as a jam sensor being provided downstream of the hand-insertion paper feeder 22 in the paper passing direction.

The body 1 is detachably provided at its inner bottom with a paper feed cassette 24. The paper feed cassette 24 is inserted into the body 1 leftwardly from the right-hand surface thereof and provided at the inner bottom swingably with a support plate 25 on which the copying paper 9 is to be placed. At the bottom of the paper feed cassette 24 below the support plate 25 is provided an opening 24*a* into which a free end of a push-up lever 26 mounted swingably on the inner bottom of body 1 is insertable, the push-up lever 26 carrying a torsion spring 27 to bias the push-up lever 26 to rotate clockwise, the support plate 25 being biased upwardly by the torsion spring 27.

A paper feed roller 28 for feeding the copying paper 9 one by one is provided above and near the insertion side end of the paper feed cassette 24 and urges by its empty weight the uppermost copying paper 9. Accordingly, the copying papers 9 are subjected to the empty weight of the paper feed roller 28 and sandwiched between the roller 28 and the torsion spring 27 mounted on the push-up lever 26. In addition, reference numeral 29 designates corner separators for separating the copying papers 9 one by one, which are provided at both side corners at the insertion side end of the paper feed cassette 24.

A guide 30 for U-turning upwardly the copying paper 9 fed by the paper feed cassette 28 is provided in front of the insertion side end (leftwardly thereof in FIG. 1) of the paper feed cassette 24. The guide 30 is integral with the hand-insertion paper feeder 22 so that the copying paper 9 fed from the paper feed cassette 24 passes the guide 30 and thereafter is fed as the same as when fed from the hand-insertion paper feeder 22. Also, the guide 30 is adapted to be rotatable counterclockwise from the position shown in FIG. 1 using, as the fulcrum, a support shaft 31 inserted into the lower end of the guide 30.

At the downstream side of the guide 30 in the paper passing direction are provided register rollers 32 and 33 which once stop the copying paper 9 fed from the paper feed cassette 24 or the hand-insertion paper feeder 22 and refeed it in synchronism with operation of the original support plate 2. The lower roller 33 is connected to a drive source (not shown) and rotates continuously, the lower roller 33 and paper feed roller 28 being connected with each other through two pulleys 34 and 35 and a belt 36. In addition, a clutch (not shown) is assumed to be interposed between the paper feed roller 28 and the pulley 35.

The upper roller 32 is mounted rotatably on one end (the upstream end of the paper passing direction) of a lever 38, the lever 38 is fixed to a holding shaft 37 provided rotatably at the body 1. The other end (downstream end of the paper passing direction) of the lever 38 is bent in a L-like shape so that the other end of the lever 38 can check the copying paper 9 fed from the paper feed cassette 24 or the handinsertion paper feeder 22 at the end of paper 9 at the downstream side in the paper passing direction. In addition, the lever 38 is balanced in the lateral moments created around the holding shaft 37 so that the pair of register rollers 32 and 33 are not press-contact with each other until the copying paper 9 arrives at the rollers. Accordingly, even when the lower roller 33 rotates continuously, the upper roller 32 is not biased to rotate, whereby the copying paper 9, which arrives merely between the register rollers 32 and 33, is not transported thereby.

However, when the downstream end in the paper passing direction of the copying paper 9 fed manually or from the paper feed roller 28 is checked by the L-like-shaped portion of the lever 38, the lever 38 is given a moment created counterclockwise in FIG. 1 around the holding shaft 37 so that the register rollers 32 and 33 put therebetween the copying paper 9 to apply it a passing force, but in this condition, the copying paper 9 is not given the passing force enough to slidably pass below the lever 38. Hence, the copying paper 9 is kept stationary in condition of abutting at its downstream edge against the L-like-shaped portion of the lever 38, and then with the timing for operation of the original support plate 2, a plunger (not shown) mounted on the lever 38 gives thereto the counterclockwise moment, at which time the copying paper 9 is sandwiched under sufficient pressure by the pair of register rollers 32 and 33 and given a feeding force enough to pass through the L-like-shaped portion of the lever 38, thereby being fed toward the photosensitive drum 4.

A transfer corotron 39 as the transfer means to transfer to the copying paper 9 the toner image developed by the developing means 14 is provided below and opposite to the photosensitive drum 4, and downstream of the transfer corotron 39 in the rotation direction of the photosensitive drum 4 is disposed adjacently to the corotron 39 the peel-off pawl 11 for peeling the copying paper 9 from the photosensitive drum 4, the peel-off pawl 11 being mounted rotatably on a support shaft 42 of an upper roller 40 of a pair of transfer rollers 40 and 41 and rotatably biased by a spring (not shown) toward the surface of photosensitive drum 4.

Figure 2:
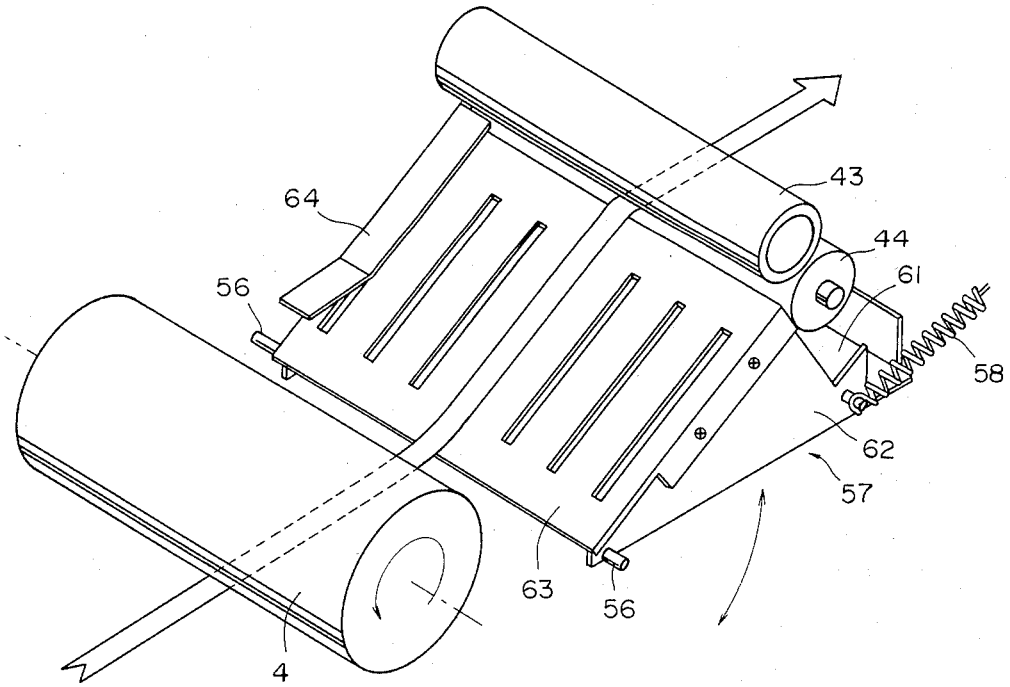
FIG. 2 is a perspective view of a guide means for a recording paper.
Figure 3:
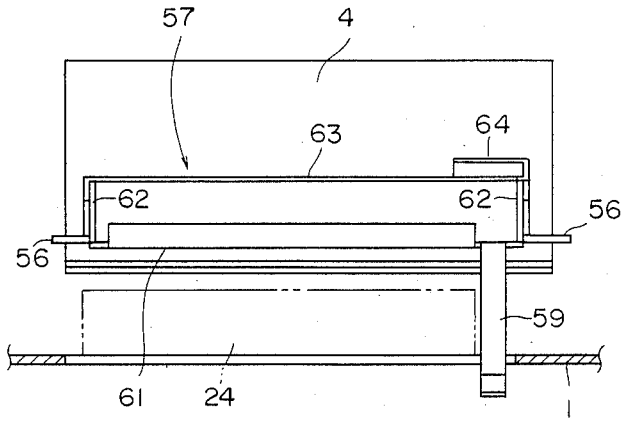
FIG. 3 is a schematic front view of the guide means.

At the downstream side of the transfer rollers 40 and 41 in the paper passing direction is provided a guide means 57 therefore as detailed in FIGS. 2 and 3. In addition, the unshaded arrow in FIG. 2 represents the passing route of copying paper 9.

The guide means 57, as shown in FIG. 2, comprises a base plate 61, both side plates 62, 62 erected from both sides thereof and each formed of a substantially triangle having the apex upstream in the paper passing direction, and a guide plate 63 connecting the oblique sides at the triangular side plates 62 at the upstream side in the paper passing direction. The top of the guide plate 63 provides a surface for the paper 9 to move or slide upon and be guided from photosensitive drum 4 to pass between heating roller 43 and pressure roller 44 (see FIG. 2). A restraining plate 64 is mounted on the top surface of guide plate 63 adjacent one edge of the latter as shown. As the copying paper 9 moves away from photosensitive drum 4, an edge portion of the paper 9 is guided via an upward bent front portion of restraining plate 64 to slide between the restraining plate 64 and guide plate 63. In this manner, because of the "hardness" of the copying paper 9 and gravity, the entire surface thereof is restrained from floating upward or moving away the top surface of guide plate 63 as the former slides thereupon. Note that the width of restraining plate 64 is made sufficiently wide to provide the desired function, but is limited in width to avoid any contact with the toner image area on the copy paper 9 to prevent smearing of the image. For the same reason, the peel off pawl 11 only contacts the same edge of paper 9 as restraining plate 64, in this example. Also, the guide means 57 as a whole is supported to the body 1 through support shafts 56, 56 projecting at the apexes of both side plates 62, 62 upstream in the paper passing direction in relation of being swingable around the axis parallel to that of the photosensitive drum 4. A coiled spring 58 is stretched between the downstream portion of one side plate 62 in the paper passing direction and the body 1 so that tension of the coiled spring 58 allows the guide means 57 to align both the fulcra of the coiled spring 58 and the support shafts 56, 56 respectively in condition as shown in FIGS. 1, 2 and 3, thereby keeping a stable positional relation of the guide means 57 with respect to the body 1.

At the downstream end of the guide means 57 in the paper passing direction (farthest apart from the support shafts 56, 56 concretely, the downstream end of the base plate 61 in the paper passing direction) is fixed a lever 59 which is to project downwardly from the bottom of the body 1 when the guide means 57 is kept in a stable condition. While, an opening 60 through which the copying paper 9 is passable is provided at the bottom of the body 1 in a range corresponding to the guide means 57, the lever 59 thereof, as shown in FIGS. 1 and 3, projecting at the utmost end from the opening 60 to an extent of not-contacting with the surface of a desk or the like when the body 1 is placed on the desk in normal condition.

At the downstream side of the guide means 57 in the paper passing direction is provided a fixing means 45 comprising a heating roller 43 insertably supporting therein a halogen lamp of about 800 W and a pressure roller 44 in press-contact with the heating roller 43. An oil feeding pipe 46 for feeding silicon oil to the heating roller 43 is provided to be in light press-contact with the upper portion thereof and forms at the wall of the oil feeding pipe 46 fine continuous bubbles each containing therein silicon oil. Hence, the silicon oil in the oil feeding pipe 46 permeates through the wall of the oil feeding pipe 46 to be supplied gradually onto the heating roller 43. At the left side of the pressure roller 44 is provided a torsion spring (not shown) to bias the pressure roller 44 counterclockwise in FIGS. 1, 2 and 3, toward the heating roller 43.

Now, the copying paper 9 fixed with the toner image by the fixing means 45 is discharged onto a paper discharge tray 48 provided above the paper feed cassette 24, the paper discharge tray 48 freely projecting or retracting from or into the body 1, thereby being retracted therein as a whole and projected from the body 1 when not in use.

At the downstream side (upwardly in FIG. 1) of the peel-off pawl 11 in the rotation direction of the photosensitive drum 4 is provided a cleaning means 49 for removing from the photosensitive drum 4 the residual toner not completely transferred to the copying paper 9. The cleaning means 49 contains a rubber blade 50 for peeling-off the residual toner from the photosensitive drum 4 and a screw conveyor 51 for discharging the peeled-off toner, the blade 50 providing a spring (not shown) to bias the fore edge of blade 50 counterclockwise in FIG. 1, i.e., toward the surface of the photosensitive drum 4. Also, at the downstream side (upwardly in FIG. 1) of the cleaning means 49 in the rotation direction of the photosensitive drum 4 is provided an eraser lamp 52 for completely erasing the residual charge on the photosensitive drum 4. In addition, reference numeral 53 designates a filter for the eraser lamp 52.

At the right-hand surface of the body 1, i.e., at the side thereof on which the paper discharge tray 48 and the paper feed cassette 24 are mounted, a handle 54 for lifting up and carrying the apparatus of the invention is fixed.

Furthermore, at the outer surface of the opposite side (the left-hand surface) of the body 1 to the above handle fixing side and at two lateral portions, right-prism-like-shaped rubber cushions 55 extending vertically are fixed, the rubber cushions 55 serving as the support legs and to protect the body 1 when lifted as a whole and placed on the desk or the like.

Next, explanation will be given on operation of the image forming apparatus of the invention.

At first, an original is placed on the original support plate 2, and thereafter upon turning a copy start switch (not shown) on, the original support plate 2 once moves rightwardly in FIG. 1 because the apparatus of the invention provides a lens system and the photosensitive drum 4 as the latent image holder at the central portion of the body 1 in the moving direction of the original support plate 2, and then moves leftwardly, and agains rightwardly to thereby return to the initial position. During the rightward movement, the original image is projected and image-formed on the photosensitive drum 4 so that the latent images corresponding to th original image is formed on the same. The latent images are toner-developed by the developing means 14, the toner images being transferred by the transfer corotron 39 as the transfer means onto the copying paper 9 fed from the paper feed cassette 24. Thus, the copying paper 9 bearing the transferred toner images is peeled off by the peel off pawl 11 from the photosensitive drum 4 and subjected to heating and application of pressure at the fixing means 45 so as to be fixed, the fixed copying paper 9 being placed on the paper discharge tray 48. In addition, the residual charge and the toner not thoroughly transferred but remaining on the photosensitive drum 4 are removed by the cleaning means 49 and the eraser lamp 52.

Figure 4:
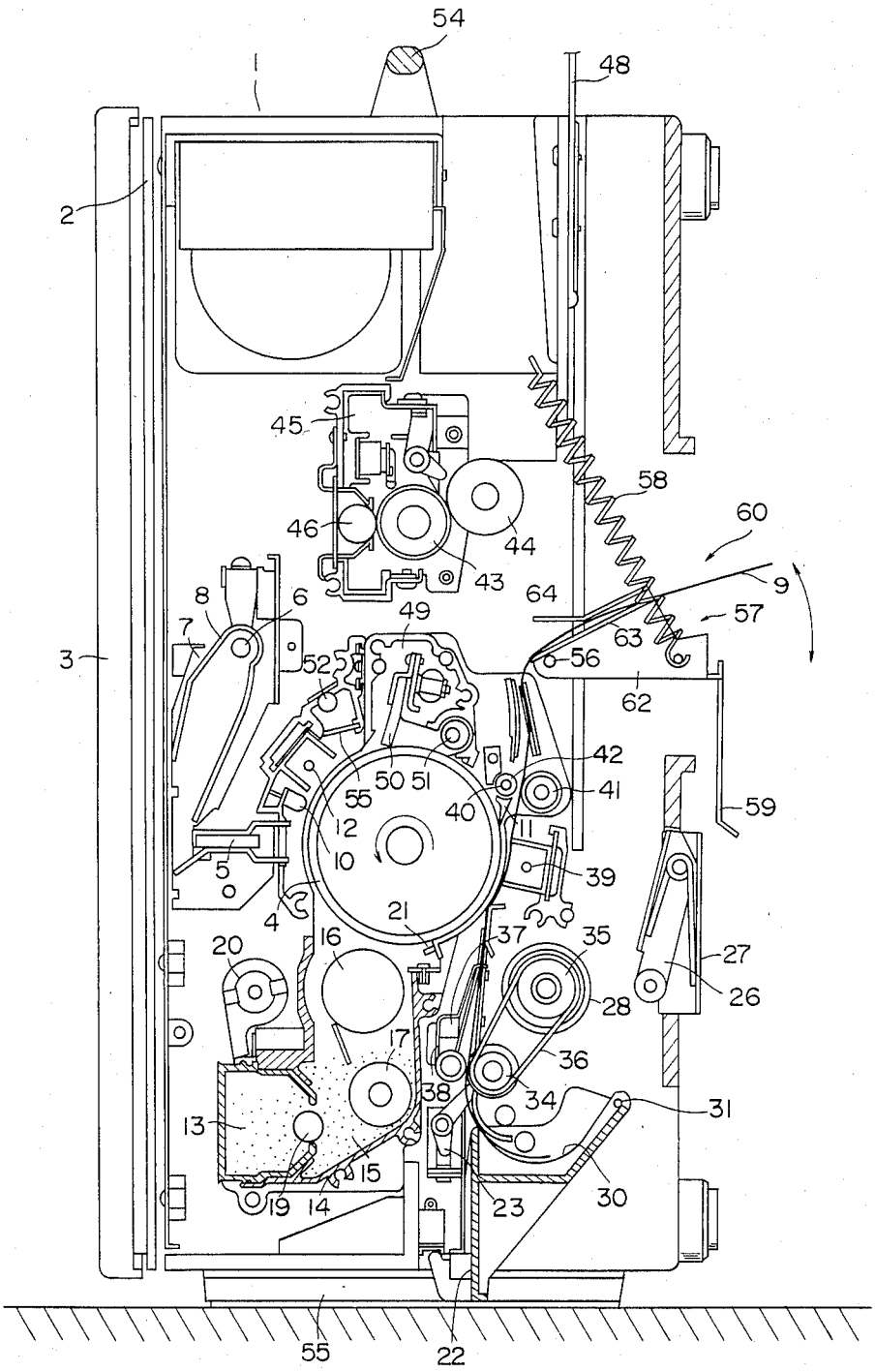
FIG. 4 is a sectional view of the FIG. 1 embodiment in condition of standing-up keeping downwardly the leftside surface.
Figure 5:
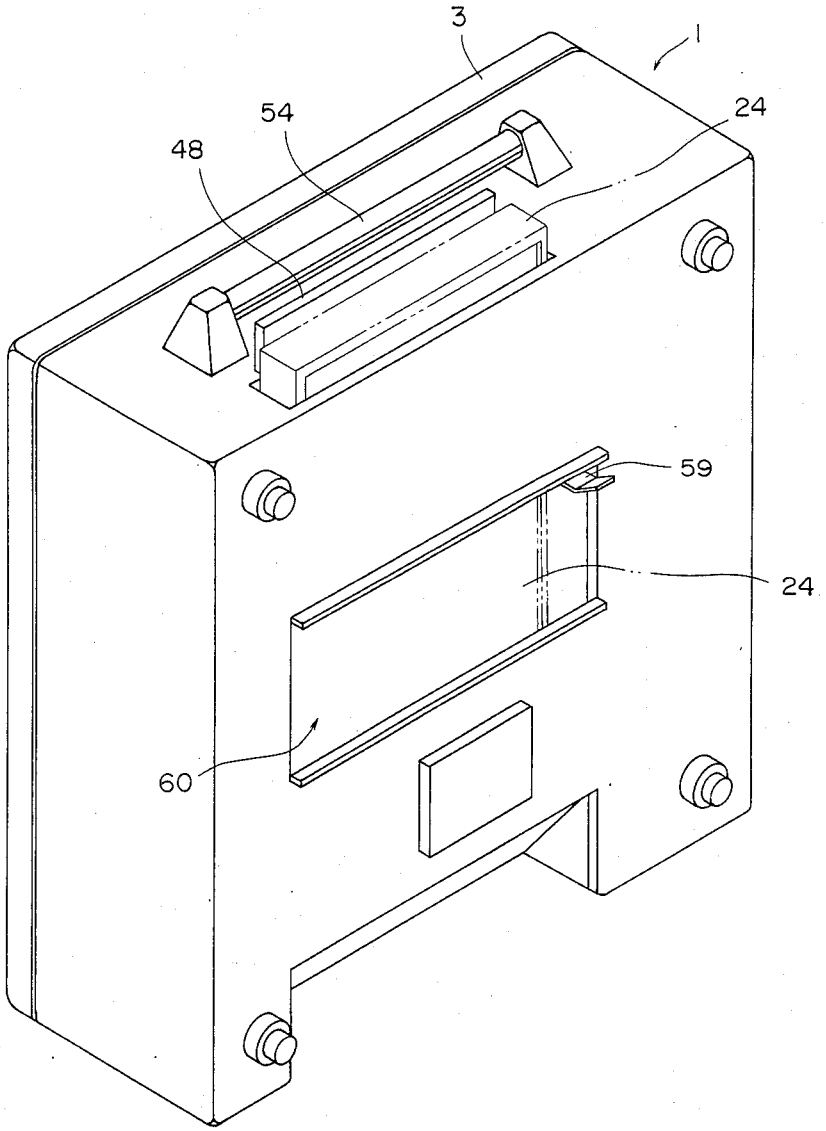
FIGS. 5 and 6 are perspective views of the apparatus in FIG. 4 when viewed from the right hand thereof.
Figure 6:
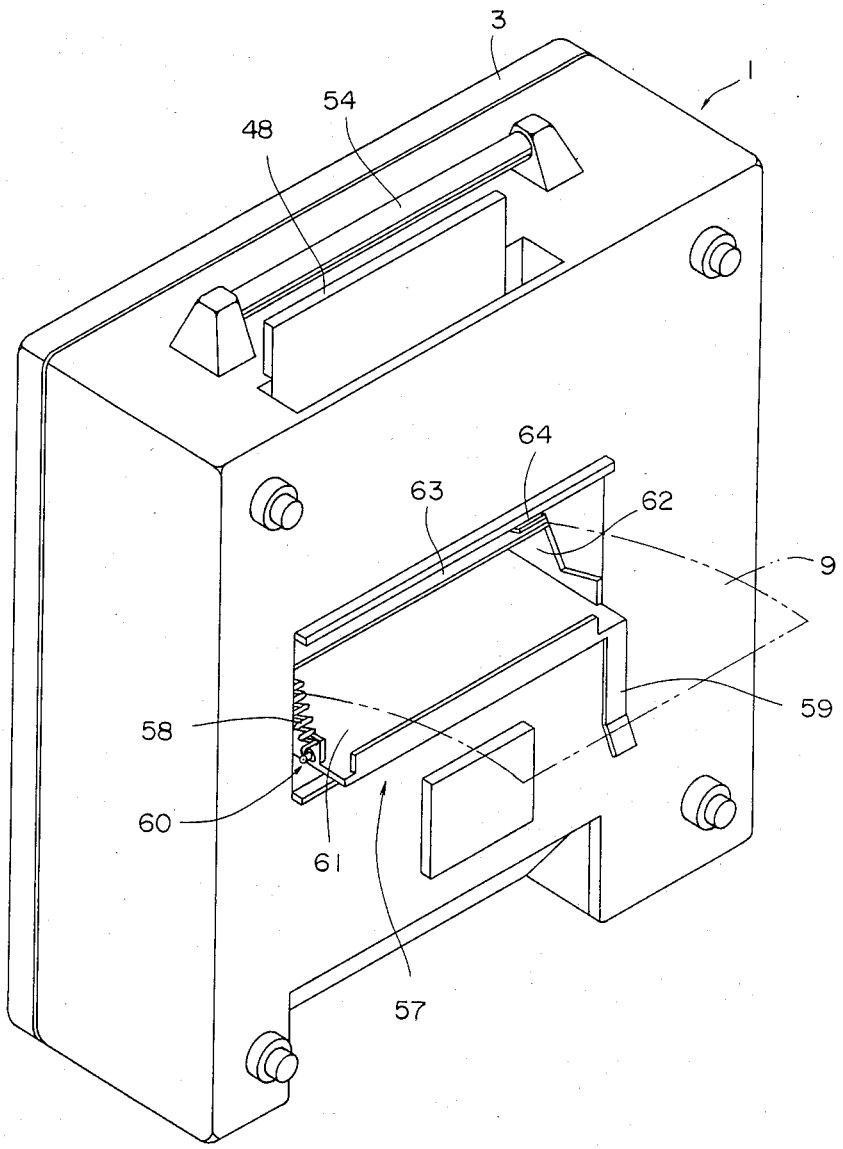

Next, as shown in FIG. 1, in a case where the copying paper 9 jams across the transfer corotron 39 and the fixing means 45, the disposal for the apparatus of the invention will be explained in accordance with the sectional view in FIG. 4 showing the same in condition of standing keeping below the left side thereof in FIG. 1 and the FIGS. 5 and 6 perspective views showing the bottom of the apparatus of the invention.

At first, an operator pulls out the paper feed cassette 24 from the body 1 and holds the handle 54 at the right-hand surface to stand the body 1 keeping the rubber cushions 55 at the left-hand surface of the body 1 below. Such condition is shown in FIG. 5, in which, for reference, the paper feed cassette 24 in condition of being mounted on the body 1 is shown by the imaginary line. In this condition in FIG. 5, the lever 59 at the guide means 57 somewhat projects at the utmost end from the opening 60 at the bottom of the body 1. The operator pinches the utmost end of the lever 59 to pull out it while turning it against the tension of the spring 58, thereby putting the guide means 57 in condition as shown in FIGS. 4 and 6. Namely, the guide means 57 is rotated clockwise in FIGS. 1 and 4 around the support shafts 56, 56 so that the end portion of the guide means 57 downstream in the paper passing direction projects outwardly from the opening 60 at the bottom of the body 1. At this time, since the jammed copying paper 9 is inserted at the portion downstream in the paper passing direction between the guide plate 63 and the restraining plate 64 of the guide means 57, the end of copying paper 9 at the downstream side in the paper passing direction thereof projects outwardly from the body 1 through the opening 60 as the guide means 57 rotates as shown in FIGS. 4 and 6. Accordingly, the operator grips projecting part of the copying paper 9 and pulls it, thereby enabling the jammed paper 9 to be taken out from the body 1 with ease.

Also, in a case where the copying paper 9 is jammed prior to complete feeding thereof from the paper feed cassette 24, in order to remove the jammed paper 9, the operator need only rotate counterclockwise in FIG. 1 the hand-insertion paper feeder 22 and the guide 30 mounted rotatably and integrally with each other on the body 1 through the support shaft 31. Therefore, an opening is formed at the left side lower portion of the body 1 so that the jammed copying paper 9 is exposed outwardly between the fore end at the insertion side (the leftward end in FIG. 1) of the paper feed cassette 24 and the pair of register rollers 32 and 33. Accordingly, the operator grips the paper 9 and pulls out it to thereby remove the jammed copying paper 9 outwardly from the body 1 with ease. As this invention may be embodied in several forms without departing from the spirit of essential characteristics thereof, the present embodiment is therefore illustrative and not restrictive, since the scope of the invention is defined by the appended claims rather than by the description preceding them, and all changes that fall within meets and bounds of the claims, or equivalence of such meets and bounds thereof are therefore intended to be embraced by the claims.

What is claimed is:

1. An image forming apparatus provided in a casing having relative to the operating position of said apparatus, top, bottom, front, back, and right and left side surfaces, said apparatus comprising:

a latent image holder;

a developing means which develops latent images formed on said latent image holder so as to form toner images thereon;

a transfer means for transferring said toner images formed on said latent image holder to a recording paper;

a fixing means for fixing onto said recording paper said toner images transferred to said recording paper by said transfer means, so that a portion along the bottom of said casing is used as a passing route for said recording paper, characterized in that at the bottom of said casing an opening is formed having a larger length in the direction perpendicular to the passing direction of said recording paper than a width of said recording paper;

a handle(s) mounted on the front of said casing, said casing being adapted to be capable of standing on its back side, for permitting access to said opening in the bottom of said case for removal of jammed paper; and guide means for said recording paper mounted within said casing above said opening, said guide means constituting a portion of said passing route and being rotatable toward said opening.

2. An image forming apparatus as set forth in claim 1, wherein members supporting said casing are provided at the back surface thereof.

3. An image forming apparatus as set forth in claim 1, wherein said opening is provided at a portion on the bottom of said casing below the position between said transfer means and said fixing means.

4. An image forming apparatus as set forth in claim 3, wherein members for supporting said casing are provided at the back surface thereof.

5. An image forming apparatus as set forth in claim 1, wherein said guide means includes:

a guide face constituting part of said passing route, a restraining member for restraining said recording paper from moving away from said guide face, and support shafts using one end thereof in the passing direction as the axis of rotation with respect to said casing and rotatable at the other end toward said opening.

6. An image forming apparatus as set forth in claim 5, wherein members for supporting said casing are provided at the back surface thereof.

7. An image forming apparatus as set forth in claim 5, wherein said opening is provided at a portion on the bottom of said casing below the position between said transfer means and said fixing means.

8. An image forming apparatus as set forth in claim 7, wherein members for supporting said casing are provided at the back surface thereof.

* * * * *